US005605478A

United States Patent [19]

Woodard

[11] Patent Number: 5,605,478

[45] Date of Patent: Feb. 25, 1997

[54] MEANS FOR ATTACHING A CONNECTOR BODY TO AN ELECTRIC DEVICE

[75] Inventor: Tony O. Woodard, Pine Level, N.C.

[73] Assignee: Eaton Corporation, Cleveland, Ohio

[21] Appl. No.: 491,774

[22] Filed: Jun. 19, 1995

[51] Int. Cl.[6] ..... H01R 13/502

[52] U.S. Cl. ..... 439/695

[58] Field of Search ..... 439/695, 733, 439/737, 738, 733.1

[56] References Cited

U.S. PATENT DOCUMENTS 2,117,298 10/1935 Chirelstein ..... 439/733.1

2,958,068 10/1960 Lipinski ..... 439/695

*Primary Examiner*—Neil Abrams
*Assistant Examiner*—Yong Kim
*Attorney, Agent, or Firm*—Larry G. Vande Zande

[57] ABSTRACT

A molded insulating connector body is pinned to the housing of an electrical device such as a switch, indicating light, instrument, gauge or the like to selectively provide a particularly keyed connector body to devices of the same type by a pin which extends through holes in the device terminals and correspondingly aligned openings in the connector body. The pin is retained in place by a collar which envelopes the electrical device body and is threadably attached thereto.

16 Claims, 2 Drawing Sheets

MEANS FOR ATTACHING A CONNECTOR BODY TO AN ELECTRIC DEVICE

BACKGROUND OF THE INVENTION

This invention relates to electric devices which are connected in an electric circuit by plug-in electric connectors which attach to the terminals of the device. Plug-in connectors which are part of an electrical wiring harness such as for vehicle application, are often keyed to insure that the respective wires of the harness are connected to the proper device. In certain instances, the same electrical device may be used in a plurality of applications, the only difference being a requirement for different keying at the plug-in connector body of the device. If the connector body is an integral part of the molded housing of the device, such requirement for different keying in the connector body requires a different device housing and therefore, a different device.

SUMMARY OF THE INVENTION

This invention provides an electric device having a connector body attached to the device by a pin which extends through the connector body and the device terminals, the pin being retained in place by a protective collar which envelopes the device and overlies the openings in the connector body in which the pin is disposed, blocking removal of the pin. The connector body may be selectively chosen from a plurality of connector bodies, each having different keying. In a preferred embodiment the collar is threadably attached to a threaded bushing of the device and may be screwed tightly down upon the connector body to provide a sealed superstructure for the device.

These and other advantages of the invention will become more apparent when reading the following description and claims in conjunction with the accompanying drawing.

DETAILED DESCRIPTION OF THE PREFERRED EMBODIMENT

Figure 4:
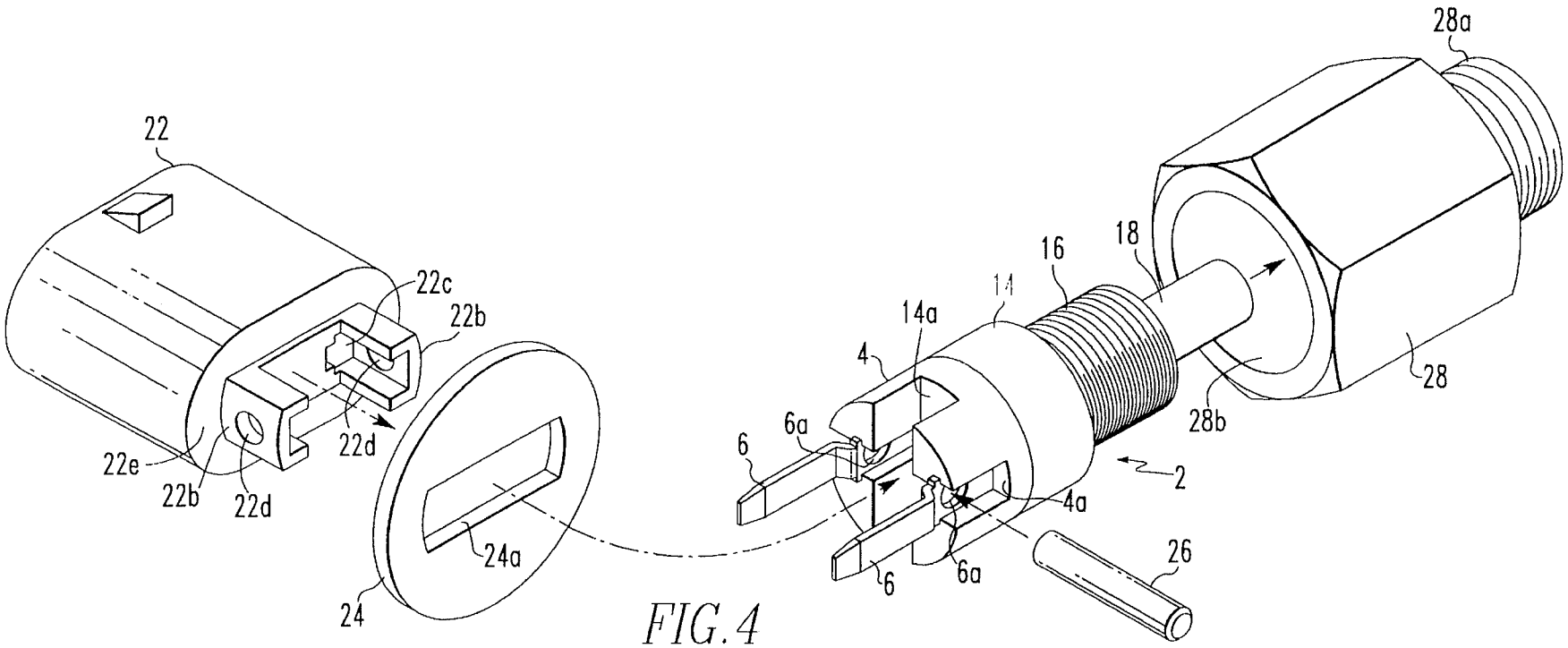
FIG. 4 is an exploded isometric view of the major components of the electric switch assembly embodying this invention.

This invention can be used with various types of electric devices such as switches, indicators, lamps, gauges and the like. To illustrate the invention, it is shown in conjunction with a self contained pushbutton switch 2 shown in FIGS. 1 and 4. Switch 2 comprises an insulating base 4 to which a pair of electric terminals 6 are affixed, the inner ends of the terminals functioning as stationary contacts for the switch. A movable contact 8 is mounted on a movable insulating contact carrier assembly 10 which is biased away from the stationary contacts by a spring 12 located in a central cavity of the base 4. The movable contact carrier assembly 10 is freely guided for movement within a metal cover 14 which is attached to base 4 by clinching over a pair of tabs such as 14*a* shown in FIG. 4. A threaded bushing 16 is attached to the cover 14 at the end remote from base 4 by spinning over a reduced diameter portion of the bushing 16. A pushbutton operator plunger 18 is slidably captured within the threaded bushing 16 and biased outwardly thereof by a helical compression spring 20 which bears between the movable contact carrier assembly 10 and the interior of pushbutton 18. Depression of pushbutton 18 compresses spring 20 which overcomes the oppositely directed force of spring 12 to drive the movable contact carrier assembly 10 and movable contact 8 thereof into bridging engagement with the stationary contact portions of terminals 6, thereby closing a circuit between the two terminals.

Figure 1:
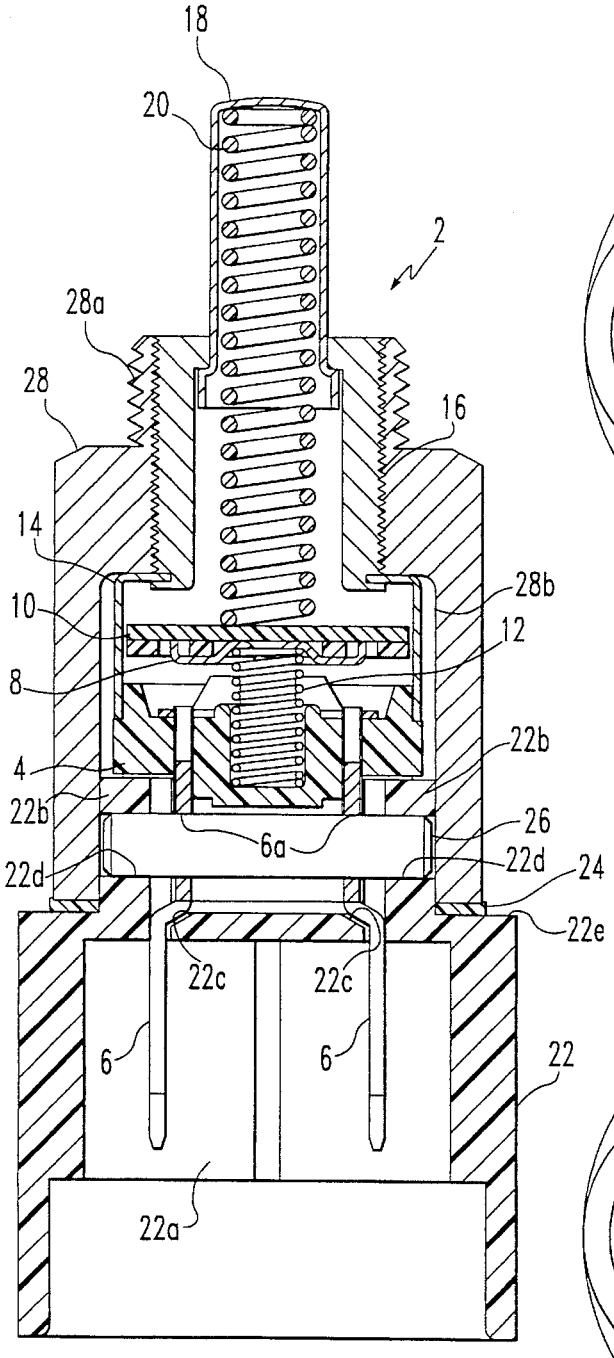
FIG. 1 is a cross sectional view taken along the center line of an electric switch assembly constructed in accordance with this invention.

A molded insulating connector body 22 is provided for attachment to switch 2 to provide a receptacle for a mating plug-in connector (not shown). Referring to FIG. 1, the connector body 22 has a central cavity 22*a* open to one end thereof. The opposite end of connector body 22 is substantially closed and has a pair of projections 22*b* extending from the closed end. That end of the connector body is provided with holes 22*c* adjacent each of the projections 22*b*. The inside edges of projections 22*b* are channeled to nest around the narrowed projecting portions of terminals 6, the terminals 6 also extending through holes 22*c* into cavity 22*a* of connector body 22. The projections 22*b* each have openings 22*d*. Terminals 6 have holes 6*a* formed in a wider portion of the terminal which is inset within the base 4 of switch 2 (see particularly FIG. 4), but exposed by rectangular recesses 4a adjacent the terminals 6 and open to the lower end of base 4.

A disc 24 of insulating material has an oblong opening 24*a* which is complemental to the outer profile of the two projections 22*b* and the interconnecting land between these projections. Disc 24 is placed over projections 22*b* to rest against a shoulder 22*e* on connector body 22, thereby providing a large circular sealing surface on the connector body 22. The connector body 22 is inserted over the lower end of switch 2 whereby the terminals 6 are received through openings 22*c* in the connector body. The projections 22*b* nest over the narrowed portions of terminals 6 and within the recesses 4*a* of base 4 mechanically interlock the connector body on the switch 2. An insulating pin 26 is inserted through openings 22*d* and holes 6*a* to pin the connector body 22 to the switch terminals 6 and therefore to the switch 2.

A hexagonal shaped collar 28 having a threaded bushing 28*a* at one end and a cylindrical cavity 28*b* open to the opposite end is disposed over switch 2. Threaded bushing 28*a* is internally threaded to engage with the threaded bushing 16 of switch 2 whereby the collar 28 is threadably attached to the switch 2. Collar 28 envelopes switch 2 and the projections 22*b* of connector body 22, overlying the openings 22*d* and the opposite ends of pin 26 to prevent removal of the pin and therefore to prevent disassembly of the connector body 22 from the switch 2. Collar 28 is threadably rotated against a surface of member 24 and in turn against the shoulder 22*e* of connector body 22 to provide a seal and additional stability to the assembly.

Figure 2:
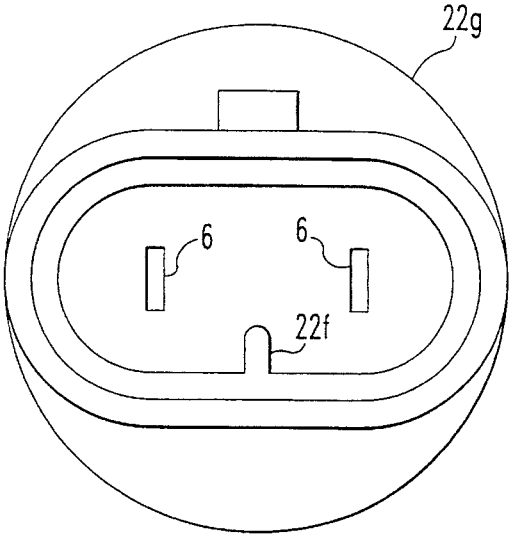
FIG. 2 is a lower end view of the switch assembly of FIG. 1 showing the open end of the connector body and switch terminals of a first form of keying for the connector body.
Figure 3:
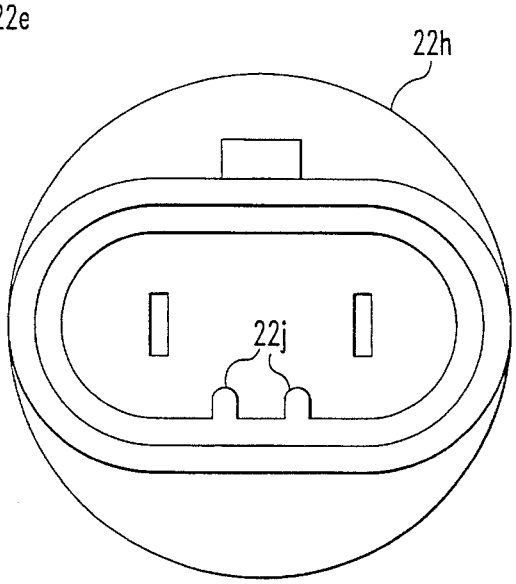
FIG. 3 is a view like FIG. 2, but showing a second form of keying for the connector body.

As seen in FIGS. 2 and 3, the interior surface of cavity 22*a* of connector body 22 is provided with a key structure which requires that the mating plug-in part be formed with a complemental key structure. In the examples shown, the key is a rib 22*f* in a first connector body 22*g* shown in FIG. 2, the rib 22*f* extending in the direction toward the open end of connector body 22. A second connector body 22*h* is shown in FIG. 3 having a different type of keying wherein a pair of parallel ribs 22*j* are provided in the interior surface of cavity 22*a* of connector body 22. Thus a switch assembly can be provided using the same switch 2 but selectively provided with different keying for the plug-in connector by pinning a selected connector body to the switch.

The embodiment shown and described herein is a preferred embodiment and represents the best known mode of carrying out the invention at the time of filing this application. However, it is to be understood that the invention is susceptible of various modifications without departing from the scope of the appended claims. For example, the single pin 26 could be substituted for by a pair of pins separately inserted from either direction at the outsides of projections 22*b*. Such pins could be made to snap into place within the holes 22*d*, therefore obviating the need of a collar. The collar 28 could be attached to the switch only around the area of the projections 22*b* and could be affixed to the switch 2 in several ways, including a threaded coupling between the collar and the projections 22*b*. The collar could also be snap fit to the projections 22*b* with suitable structural modifications to both the collar and the projections. The keying structure has been illustrated as comprising one or more ribs extending substantially axially of the switch assembly. However, the interior shape per se of the cavity 22*a* and the exterior shape of the mating plug could equally serve as a keying structure, as well as many other shapes or locations of ribs that may be added to the interior surface of cavity 22*a*.

I claim:

1. Means for attaching a connector body to an electric device comprising:

an electric device having a housing and a pair of spaced apart terminals projecting from said housing, said terminals each having a hole therethrough;

a connector body disposed over said terminals said connector body having a cavity open to an end disposed away from said housing, said terminals being disposed in said cavity, said connector body having openings aligned with said holes in said terminals;

pin means inserted through said connector body openings into said terminal holes for attaching said connector body to said electric device; and means blocking withdrawal of said pin means from said connector body.

2. The means for attaching a connector body to an electric device of claim 1 wherein said connector body comprises a shape within said cavity defining a key for limiting receipt of a plug-in connector plug within said connector body cavity to a particular said plug having a shape complemental to said shape within said cavity.

3. The means for attaching a connector body to an electric device of claim 2 wherein said connector body is selected from a plurality of connector bodies each having uniquely different shapes within said cavity to respectively define different keys.

4. The means for attaching a connector body to an electric device of claim 1 wherein said pin means comprises a single member extending commonly through said holes and said openings.

5. The means for attaching a connector body to an electric device of claim 1 wherein said device housing has recesses adjacent said terminals at said holes, said recesses being open to an end of said switch housing adjacent said connector body, and said connector body comprising projections complemental to and extending into said recesses, said connector body openings being disposed in said projections.

6. Means for attaching a connector body to an electric switch comprising:

an electric switch having a housing, an operator at one end of said housing, and a pair of spaced apart terminals at an opposite end of said housing, said terminals each having a hole therethrough;

a connector body disposed over said terminals at said opposite end of said housing, said body having a cavity open to an end disposed away from said housing, said terminals being disposed in said cavity, said connector body having openings aligned with said holes in said terminals;

pin means inserted through said connector body openings into said terminal holes for attaching said connector body to said electric switch; and a collar surrounding said electrical switch and said connector body adjacent said openings, said collar blocking withdrawal of said pin means from said connector body.

7. The means for attaching a connector body to an electric switch of claim 6 wherein said connector body comprises a shape within said cavity defining a key for limiting receipt of a plug-in connector plug within said connector body cavity to a particular said plug having a shape complemental to said shape within said cavity.

8. The means for attaching a connector body to an electric switch of claim 7 wherein said connector body is selected from a plurality of connector bodies each having uniquely different shapes within said cavity to respectively define different keys.

9. The means for attaching a connector body to an electric switch of claim 6 wherein said pin means comprises a single member extending commonly through said holes and said openings.

10. The means for attaching a connector body to an electric switch of claim 6 wherein said electric switch comprises a threaded bushing at said one end of said housing and said collar comprises an internally threaded portion threadably engaged with said bushing, said collar enveloping said switch housing.

11. The means for attaching a connector body to an electric switch of claim 6 wherein said switch housing has recesses adjacent said terminals at said holes, said recesses being open to said opposite end of said switch housing, and said connector body comprising projections extending into said recesses, said openings being disposed in said projections.

12. An electric switch assembly having a selected one of a plurality of different connector bodies attached to an electric switch housing comprising:

a self-contained electric switch having a housing including a threaded bushing at one end of said housing, a switch operator extending through said bushing, a pair of spaced apart terminals extending from an opposite end of said housing, said terminals each having a hole therethrough;

a selected connector body disposed over said terminals at said opposite end of said housing, said body having a cavity open to an end thereof disposed away from said housing, said terminals being disposed in said cavity, said connector body having openings aligned with said holes in said terminals;

pin means inserted through said connector body openings into said terminal holes for attaching said connector body to said electric switch; and a generally tubular collar having a threaded opening at one end disposed over said electric switch and said connector body adjacent said openings, said collar threadably engaging said threaded bushing for securing said collar and said switch together, said collar blocking withdrawal of said pin means from said connector body and said electric switch.

13. The electric switch assembly of claim 12 wherein said connector body comprises a particular shape within said cavity defining a key for limiting receipt of a plug-in connector plug within said cavity to a particular said plug having a shape complemental to said shape within said cavity.

14. The electric switch assembly of claim 13 wherein said particular shape comprises one or more ribs in said cavity directed toward said open end of said cavity.

15. The electric switch assembly of claim 12 wherein said pin means comprises an insulating member extending commonly through said holes and said openings.

16. The electric switch assembly of claim 12 wherein said connector body comprises projections extending along said terminals adjacent said holes, and said openings are provided in said projections.

* * * * *